United States Patent [19]

Nandi et al.

[11] 4,234,387

[45] Nov. 18, 1980

[54] COKING POOR COKING COALS AND HYDROCRACKED TAR SAND BITUMEN BINDER

[75] Inventors: Biswa N. Nandi; Keith Belinko; Lynn A. Ciavaglia; Barry B. Pruden, all of Ottawa; Jean-Marie D. Denis, Munster, all of Canada

[73] Assignee: Her Majesty the Queen in right of Canada, as represented by the Minister of Energy, Mines and Resources, Ottawa, Canada

[21] Appl. No.: 954,322

[22] Filed: Oct. 24, 1978

[30] Foreign Application Priority Data

Apr. 28, 1978 [CA] Canada ..... 30227

[51] Int. Cl.[3] ..... C10B 55/02

[52] U.S. Cl. ..... 201/23; 201/8; 208/11 R; 44/15 R

[58] Field of Search ..... 44/15 R; 208/11 R; 201/21, 23, 8, 6

[56] References Cited

U.S. PATENT DOCUMENTS

| | | | |
|---|---|---|---|
| 1,182,738 | 5/1916 | Becker | 201/21 |
| 3,001,856 | 9/1961 | Reerink et al. | 44/23 |
| 3,094,399 | 6/1963 | Macqueen | 44/23 |
| 3,384,557 | 5/1968 | Saller | 201/22 |
| 3,546,076 | 12/1970 | Muller et al. | 201/6 |
| 3,619,376 | 11/1971 | Patel et al. | 201/6 |
| 4,001,105 | 10/1974 | Gifford | 201/21 |
| 4,102,750 | 7/1978 | Nishihara et al. | 201/6 |
| 4,135,983 | 1/1979 | Kiritani | 201/21 |

FOREIGN PATENT DOCUMENTS

| | | |
|---|---|---|
| 608,761 | 11/1960 | Canada . |
| 758,576 | 5/1967 | Canada . |
| 759,936 | 5/1967 | Canada . |
| 897,355 | 4/1972 | Canada . |
| 901,209 | 5/1972 | Canada . |
| 1,002,758 | 11/1972 | Canada . |

*Primary Examiner*—Norman Yudkoff

[57] ABSTRACT

A process is described for producing metallurgical coke from poor coking coals in which there is combined with the poor coking coals a small amount of an additive consisting of a bitumen residue obtained from hydrocracking of bitumen from tar sands. The residue used is that from vacuum distillation of a heavy hydrocarbon bottoms material obtained from hydrocracking of the bitumen. A high boiling organic residue from vacuum distillation to an equivalent atmospheric boiling temperature of 524° C. is preferred. The novel additive is superior in its ability to penetrate into cavities and provide excellent bonding of the components of the coal.

10 Claims, 3 Drawing Figures

COKING POOR COKING COALS AND HYDROCRACKED TAR SAND BITUMEN BINDER

This invention relates to an improved process for producing coke suitable for use in cupolas, blast furnaces and other metallurgical operations.

Typically, cokes suitable for the above purposes have been produced in coke ovens by carbonizing a blend of high and low volatile bituminous coals, or by carbonizing a blend of such coals along with other suitable ingredients such as pitch and anthracite. The types, numbers and amounts of the components are usually selected according to the ultimate properties desired in the coke.

In recent years there has been a very significant decline in the availability of good coking coals and the increasing world requirements for metallurgical coke have generated a need for new sources. An approach that has been actively investigated by a number of researchers is the addition of pitch binder to poor coking coals. As examples of this there may be mentioned Pinot et al, O.L.S. No. 3,636,232 published March 1977 as well as Gorin et al U.S. Pat. No. 4,030,982 of June 1977.

The basic strength of a coking coal is established during the plastic phase. As the reactive vitrinite macerals supply the required plasticity and fluidity, certain types of molecules which are formed during pyrolysis align to yield nematic liquid crystal structures, otherwise known as the mesophase. These liquid crystals flow over the surface of inert macerals (fusinite, semi-fusinite and micrinite) and coalesce to give rise to a reinforcing network of anisotropic domains which ultimately become a semi-coke. The strength of the coke is then related directly to the development of these anisotropic domains.

The addition of a pitch to poor coking coals serves a two-fold purpose. When added to an inert maceral-rich coal, the pitch provides the system with molecular structures that give rise to nematic liquid crystals. Furthermore, in a low fluidity coal, the pitch provides a plastic phase to overcome any diffusional restrictions on the flow and coalescence of the mesophase and also wets the surface of inert macerals. The choice and proportion of the pitch are important considerations and depend to a large extent on the coal or coal blend being used. Such pitch properties as softening point, volatile matter content, Conradson carbon residue, asphaltene content, benzene and quinoline insoluble contents and the size of the associated anisotropic spherical bodies have to be investigated when evaluating a pitch material to be used as a binder.

According to the present invention it has been found that the residue obtained from thermal hydrocracking of bitumen from tar sands is an excellent binder pitch for use in the upgrading of poor coking coals. The binder according to this invention has not only been found to have excellent binding properties toward the inert macerals of poor coking coal, but also shows appreciable penetration into the cell cavities of semi-fusinite and fusinite. Furthermore, this binder has been found to react with oxidized vitrinite thereby interacting with this otherwise inert maceral. The penetration into the inert macerals and the interaction with oxidized vitrinite add to the overall strength of the coke obtained.

The bitumen residue can be added to the poor coking coal in quite widely varying amounts depending on the type of coal being used and on properties of the pitch as determined by the reaction conditions during thermal hydrocracking. However, amounts greater than about 20% by weight based on the weight of the coal generally show little additional benefit. Amounts in the range of about 5–15% are generally preferred, with an amount of approximately 10% generally being optimum.

The poor coking coals used in accordance with this invention are typically non-coking or low fluidity bituminous coals containing a relatively high content of inert macerals (fusinite, semi-fusinite and micrinite) and oxidized or partially oxidized vitrinite. The coal is crushed to a typical particle size of substantially 90% minus 3.2 mm., although coarser or finer particles may be used.

The bitumen residue may also be crushed to a particle size similar to that of the coal or even a smaller particle size, e.g. minus 50 mesh [0.3 mm] (U.S. Standard Screen). The pulverized bitumen residue and coal particles are then mixed by means of a conventional mixer. It is also possible to spray the bitumen residue in hot liquid form on the coal particles in a mixer. The blend of coal particles and bitumen residue obtained is then charged to a coke oven with or without a portion of good coking coal mixed therewith.

The coke oven can be any of the usual commercial types such as Koppers, Koppers Becker, Samat Solvay, Wilputte, Otto and Simon Carves.

The bitumen residue is a product obtained from the hydrocracking of tar sand bitumen. A typical hydrocracking operation comprises passing a tar sand bitumen through a confined hydrocracking zone maintained at a temperature between about 400° and 490° C., a pressure of about 500 to 3,500 psig and a space velocity between about 0.5 and 4.0 volumes of heavy hydrocarbon oil per hour per volume of hydrocracking capacity and in the presence of 500–50,000 s.c.f. of hydrogen per barrel of bitumen, and preferably also in the presence of a catalyst. The effluent from the hydrocracking reactor is separated in a hot separator into a gaseous stream and a heavy hydrocarbon liquid. This heavy hydrocarbon liquid is removed and is subjected to vacuum distillation, with the residue obtained being the bitumen binder of this invention. The vacuum distillation is typically conducted to an equivalent atmospheric boiling temperature in the order of about 400° C. to 575° C., preferably about 524° C.

A typical tar sand bitumen from the Athabasca district of Alberta contains at least 50% of material boiling above 524° C. and has the following analysis:

TABLE 1

| | |
|---|---|
| 1. Specific gravity, 15/15° C. | 1.009 |
| 2. Sulphur, % by wt. | 4.48 |
| 3. Ash, % by wt. | 0.59 |
| 4. Conradson Carbon Residue, % by wt. | 13.3 |
| 5. Pentane Insolubles, % by wt. | 15.5 |
| 6. Benzene Insolubles, % by wt. | 0.72 |
| 7. Vanadium content, ppm | 213 |
| 8. Nickel content, ppm | 67 |
| 9. Total acid number, mg KOH/g | 2.77 |
| 10. Total base number, mg KOH/g | 1.89 |
| 11. Carbon, % by wt. | 83.36 |
| 12. Hydrogen, % by wt. | 10.52 |
| 13. Nitrogen, % by wt. | 0.43 |
| 14. Chlorine, % by wt. | 0.00 |
| 15. Viscosity at 38° C. (Cst) | 10000 |
| 16. Pitch (524° C. + ) % by wt. | 51.5 |

In the drawings which illustrate this invention,

Figure 1:
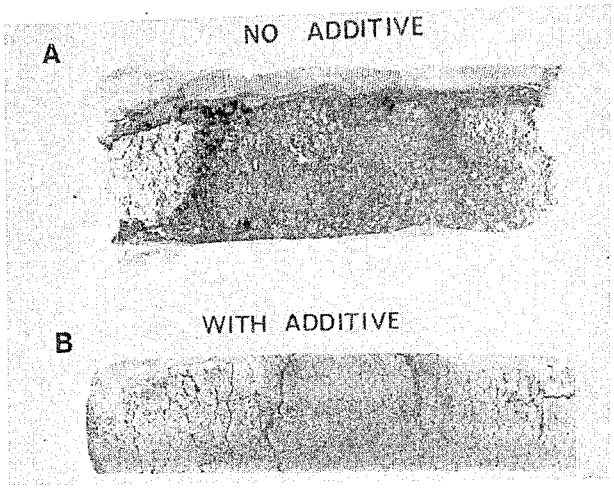
FIG. 1 is a photograph of cokes from high temperature coke oven tests.

The advantages of the present invention will now be illustrated by the following examples.

EXAMPLE 1

Coke was produced from poor coking coal using a variety of different binder pitches including the one of the present invention. The binder pitches were as follows:

Binder A

This was a coal tar pitch obtained from the Aluminum Company of Canada Ltd.

Binder B

This was a conventional petroleum derived pitch which was obtained from processing Kuwait petroleum crude.

Binder C

This was obtained from a heavy oil type of bitumen from the Cold Lake district and was obtained from vacuum distillation to 524° C. of the heavy oil itself.

Binder D

The same Cold Lake bitumen of Binder C was first subjected to thermal hydrocracking at reaction conditions shown below:

Pressure, KPa.,: 13.89
Reactor Temp., °C.: 430
Liquid Hourly Space Velocity: 2
Recycle Gas Rate scf/bbl: 3500
Recycle gas purity (hydrogen) vol.%: 85
Hot Separator Temp. °C.: 350

The heavy hydrocarbon liquid obtained from the hot separator stage was then subjected to vacuum distillation to 524° C. with the residue obtained being the binder.

Binder E

A bitumen from the tar sands of the Athabasca district of Alberta was subjected to vacuum distillation to 524° C. and the residue obtained became the binder.

Binder F

The same bitumen as used in Binder E as a starting material was subjected to thermal hydrocracking at reaction conditions shown below:

Pressure, KPa.,: 13.89
Reactor Temp., °C.: 450
Liquid hourly spaced velocity: 1
Recycle gas rate scf/bbl: 7000
Recycle gas purity (hydrogen) vol. %: 85
Hot Separator temp., °C.: 350

The heavy hydrocarbon liquid obtained after hot separation was then subjected to vacuum distillation to 524° C. with the residue obtained being the binder.

The physical and chemical properties of the binders described above are set out in Table 2 below:

TABLE 2

| Binder | F | E | D | C | B | A |
|---|---|---|---|---|---|---|
| Volatile Matter % | 54.5 | 76.9 | 68.2 | 81.8 | 42.9 | 66.3 |
| Ash % | 6.6 | 1.45 | 0.21 | 0.15 | 0.15 | 0.03 |
| Sulphur % | 4.05 | 5.78 | 5.06 | 5.87 | 6.15 | 0.59 |

TABLE 2-continued

| Binder | F | E | D | C | B | A |
|---|---|---|---|---|---|---|
| Nitrogen % | 1.25 | 0.62 | 0.80 | 0.66 | 0.88 | 0.98 |
| Oxygen % (by difference) | 7.79 | 2.76 | 2.65 | 0.10 | 1.06 | 5.45 |
| Softening point °C. (Ball and Ring) | 143 | 94 | 122 | 79 | 174 | 88 |
| CCR* % | 70.6 | 23.7 | 48.1 | 26.8 | 78.6 | 51.7 |
| Specific Gravity | 1.25 | 1.08 | 1.22 | 1.08 | — | — |
| Benzene Insolubles+ | 16.8 | Nil | 14.7 | Nil | 50.1 | 30.1 |
| Quinoline Insolubles+ | 4.1 | Nil | Nil | Nil | 17.0 | — |
| Asphaltenes | 50.3 | 30.2 | 44.6 | 35.3 | 24.4 | 60.7 |
| H/C | 0.90 | 1.27 | 1.14 | 1.40 | 0.77 | 1.33 |

*Conradson Carbon Residue
+Ash-free basis

The coal which was used was Carbon Creek coal, obtained from Western Canada, which is a partially oxidized, poor coking, low volatile coal with relatively high proportions of inert macerals. The properties of this coal are given in Table 3 below:

TABLE 3

| Properties of Carbon Creek Coal | |
|---|---|
| Proximtate Analysis | |
| Ash | 9.8% |
| Volatile Matter | 21.2% |
| Fixed Carbon | 69.0% |
| Ultimate Analysis | |
| Carbon | 78.2% |
| Hydrogen | 4.3% |
| Sulphur | 0.82% |
| Petrographic Analysis | |
| Vitrinite | 51.8% |
| Semi-fusinite | 34.2% |
| Fusinite | 11.2% |
| Micrinite | 2.6% |
| Exinite | 0.2% |
| Total Reactive Components* | 52.0% |
| Total Inert Components* | 48.0% |
| Mean Reflectance (in oil; Ro) | 1.17 |

*Based on International Committee of Coal Petrology Specification

The coal and binder were crushed to −50 mesh (U.S. Standard Screen), i.e. about 0.30 mm. and throughly mixed in desired proportions of 5%, 10%, 20% and 30% binder based on the coal. Dilatation tests and Free Swelling Index (FSI) were carried out according to DIN-51730 and ASTM D-720 specifications respectively. Semi-cokes were obtained from the dilatation tests carried out at 3° C./min. to 550° C. Microscopic examinations were performed on a Leitz reflected light microscope according to ASTM specifications.

The FSI results for the above coal/binder mixtures are shown in Table 4 below:

TABLE 4

| | Amount of Binder | | | |
|---|---|---|---|---|
| Binder | 5% | 10% | 20% | 30% |
| Binder A | 2.0 | 2.0 | 3.0 | 3.0 |
| Binder B | 2.5 | 3.0 | 4.0 | 3.5 |
| Binder D | 2.5 | 2.5 | 1.5 | 1.5 |
| Binder F | 2.5 | 3.5 | 4.5 | 4.0 |

The dilatation and FSI results for coal itself and 10% additions of different binders are given in Table 5 below:

TABLE 5

DILATION AND FSI MEASUREMENTS FOR CARBON CREEK COAL/BINDER MIXTURES

| Carbon Creek Coal | Softening Temp. °C. | Dilatation | Contraction | Plasticity | FSI |
|---|---|---|---|---|---|
| No Additive | 407 | Nil | 15 | 0.16 | 2.5 |
| + 10% Binder A | 318 | −13 | 18 | 0.14 | 2.0 |
| + 10% Binder B | 365 | −15 | 17 | 0.20 | 3.0 |
| + 10% Binder C | 389 | Nil | 13 | 0.18 | 1.5 |
| + 10% Binder D | 373 | −6 | 16 | 0.24 | 2.5 |
| + 10% Binder E | 340 | Nil | 15 | 0.16 | 1.5 |
| + 10% Binder F | 358 | 6 | 16 | 0.21 | 3.5 |

It will be seen from the above Table that the addition of a binder to Carbon Creek coal generally resulted in an improvement in the dilatation characteristics. The Binder F (which is the binder of the invention) gave the highest dilatation and FSI results of the various binders investigated. For instance, the addition of 10% of the Binder F of the invention to Carbon Creek coal increased the FSI from 2.5 to 3.5 and the dilatation from nil to 6.

It is also noteworthy that among the results obtained from binders produced from Athabasca bitumen, e.g. Table 5, significantly better results were obtained with residues obtained after hydrocracking (Binder F) than with the residues obtained without hydrocracking (Binder E), i.e. unprocessed bitumen pitch.

From a study of optical micrographs of semi-cokes produced, it was found that fusinite and oxidized vitrinite were poorly bonded when Carbon Creek coal was subjected to carbinization at 550° C. without a binder. These macerals, being poorly bonded, remained segregated from the remainder of the semicoke, thus rendering the Carbon Creek coal inadequate for producing good metallurgical coke. The semi-coke obtained with the Binder E showed bonding between fused vitrinite and oxidized vitrinite as well as with fusinite, but, penetration of the binder into the cell cavities of the fusinite was not apparent from the microscopic examinations.

Figure 2:
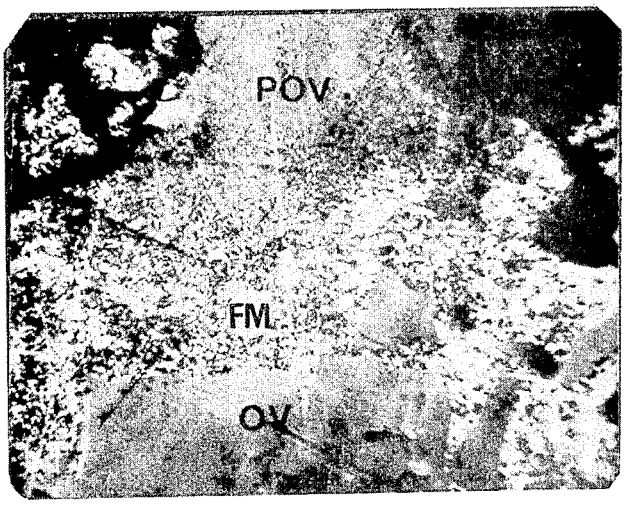
FIG. 2 is a micrograph of semi-coke according to the invention.
Figure 3:
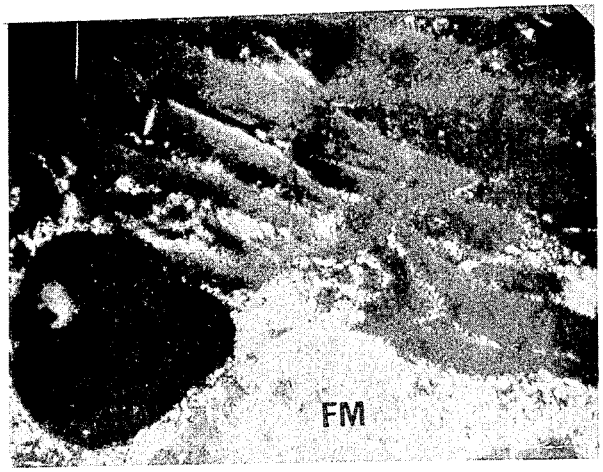
FIG. 3 is a further micrograph of the semi-coke of FIG. 2.

As shown in FIGS. 2 and 3, Binder F provided excellent bonding of the fused mass (FM) between the fused vitrinite and inert macerals, including oxidized vitrinite (OV). This binder was found to penetrate deeply into the cracked oxidized vitrinite (OV) and also into the cavities of the semi-fusinite and fusinite. It also appeared to interact with the surface of the partially oxidized vitrinite (POV) resulting in a fine mosaic grain coke formation.

The other binders tested were all found to be adequate binders for inert macerals but did not appear to appreciably penetrate the fusinite structure or to interact with the oxidized vitrinite.

EXAMPLE 2

The coal which was used was Vicary Creek coal having similar properties to Carbon Creek coal. The properties of this coal are given in Table 6 below:

TABLE 6

Properties of Vicary Creek Coal

| | |
|---|---|
| Proximate Analysis | |
| Ash | 10.8% |
| Volatile Matter | 24.8% |
| Fixed Carbon | 64.4% |
| Ultimate Analysis | |
| Carbon | 77.7% |
| Hydrogen | 4.4% |

TABLE 6-continued

Properties of Vicary Creek Coal

| | |
|---|---|
| Sulphur | 0.35% |
| Petrographic Analysis | |
| Vitrinite | 51.8% |
| Semi-fusinite | 34.1% |
| Fusinite | 9.1% |
| Micrinite | 2.4% |
| Exinite | 2.6% |
| Total Reactive Components* | 54.4% |
| Total Inert Components* | 45.6% |
| *Based on International Committee of Coal Petrology Specification. | |
| Mean Reflectance (In Oil, Ro) | 1.10 |

For this experiment, a binder of the same type as Binder F was again used. This was crushed to minus 20 mesh (U.S. Standard Screen) (0.83 mm) and the coal to 90% minus 3.2 mm. A blend of the Vicary Creek coal and 11% binder was prepared by mixing in a mechanical mixer for about one hour. 250 Kg. of this blend was charged to a 12-inch (30.5 cm) movable wall coke oven and subjected to carbonization. For comparison, a separate carbonization was carried out on the coal without binder. The carbonization conditions and results obtained are presented in Table 7 below:

TABLE 7

Data for Carbonization of 250-kg Charge of Vicary Creek Coal

| Charge Data | Vicary Creek Coal (No additive) | Vicary Creek coal + 11% hydrocracked Athabasca Bitumen Pitch |
|---|---|---|
| Moisture, % | 3.0 | 2.6 |
| Oven Bulk density, kg/m$^3$ | 817 | 818 |
| Coke yield, % | 74.8 | 74.1 |
| Pressure, KPa | 102.9 | 104.3 |
| Coking time, h | 9.75 | 10.70 |
| Centre temp., °C. | 1015 | 1010 |
| Coke Evaluation | | |
| Breeze, % minus 1.27 cm | 7.6 | 3.1 |
| Mean coke size, cm. | 5.23 | 5.03 |
| Stability factor (ASTM D-294) | 36.8 | 45.3 |
| Hardness factor (ASTM D-294) | 55.9 | 69.4 |

A significant improvement in the quality of coke produced from Vicary Creek coal was observed with addition of the hydrocracked bitumen pitch. The stability factor and hardness factor of the coke produced from the coal/binder blend increased by 23% and 24%, respectively, over those of the coke produced from the original coal. Microscopic examination of the cokes revealed enhanced bonding of inert macerals by the binder, as well as penetration of the binder into the cell cavities of fusinite and semifusinite. This can be seen from FIG. 1, in which A shows the coal carbonized alone while B shows the carbonized coal-binder blend.

The embodiments of the invention in which an exclusive property or privilege is claimed are defined as follows:

1. In a process for manufacturing metallurgical coke which comprises adding binder pitch to particles of poor coking coals and subjecting the coal with binder pitch added thereto to carbonization, the improvement which comprises utilizing as the binder pitch a bitumen residue obtained from hydrocracking of bitumen from tar sands.

2. The process according to claim 1 wherein the bitumen residue is the residue from vacuum distillation of a heavy hydrocarbon bottom product obtained from thermal hydrocracking of bitumen from tar sands.

3. The process according to claim 2 wherein the vacuum distillation is to an equivalent atmospheric boiling temperature of about 400° C. to 575° C.

4. The process according to claim 3 wherein the vacuum distillation is to an equivalent atmospheric boiling temperature of about 524° C.

5. The process according to claim 1, wherein the hydrocracking is conducted in a confined hydrocracking zone maintained at a temperature between about 400° and 490° C., a pressure of about 500 to 3,500 psig and a space velocity between about 0.5 and 4.0 volumes of heavy hydrocarbon oil per hour per volume of hydrocracking capacity and the bitumen residue is collected as a bottom product from a hot separator.

6. The process according to claim 5 wherein the hydrocracking is conducted in the presence of a hydrocracking catalyst.

7. The process according to claim 3 wherein the bitumen residue is combined with the coal particles in an amount of up to 20% by weight of coal.

8. The process according to claim 7 wherein the bitumen residue is combined with the coal particles in an amount of about 5–15% by weight of coal.

9. The process according to claim 7 or 8, wherein both the coal and bitumen residue are in pulverized form.

10. The process according to claim 7 or 8 wherein the bitumen residue is sprayed onto the coal.

* * * * *